US007982172B2

(12) United States Patent
Suzuki et al.

(10) Patent No.: US 7,982,172 B2
(45) Date of Patent: Jul. 19, 2011

(54) MICRO CHANNEL PLATE ASSEMBLY

(75) Inventors: Akio Suzuki, Hamamatsu (JP); Etsuo Iizuka, Hamamatsu (JP); Katsutoshi Nonaka, Hamamatsu (JP); Masahiro Hayashi, Hamamatsu (JP); Yuuya Washiyama, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 0 days.

(21) Appl. No.: 12/398,770

(22) Filed: Mar. 5, 2009

(65) Prior Publication Data

US 2009/0230286 A1 Sep. 17, 2009

(30) Foreign Application Priority Data

Mar. 7, 2008 (JP) ..... P2008-058392

(51) Int. Cl.
*H01J 40/14* (2006.01)
*H01J 43/00* (2006.01)

(52) U.S. Cl. ..... 250/207; 250/214 VT; 313/103 R

(58) Field of Classification Search ..... 250/207, 250/214 VT, 287, 305, 336.1; 313/103 R, 313/103 CM, 105 CM, 105 R
See application file for complete search history.

(56) References Cited

U.S. PATENT DOCUMENTS

| | | | | |
|---|---|---|---|---|
| 5,770,858 | A * | 6/1998 | Fuchs et al. | 250/287 |
| 6,828,729 | B1 | 12/2004 | Owens et al. | |
| 6,958,474 | B2 | 10/2005 | Laprade et al. | |
| 7,026,177 | B2 | 4/2006 | Laprade | |
| 2008/0230686 | A1 | 9/2008 | Suzuki et al. | |

FOREIGN PATENT DOCUMENTS

| | | |
|---|---|---|
| JP | 2005-351887 | 12/2005 |
| JP | 2007-087885 | 4/2007 |

* cited by examiner

*Primary Examiner* — Georgia Y Epps
*Assistant Examiner* — Don Williams
(74) *Attorney, Agent, or Firm* — Drinker Biddle & Reath LLP

(57) ABSTRACT

In an MCP assembly 10 having one or a plurality of MCPs 5, 6 sandwiched with an input-side electrode 4 and an output-side electrode 7, there provided at the surface facing the MCP 5, 6 of at least either (preferably, both) of the input-side electrode 4 and the output-side electrode 7, is a substantially annular contact face that contacts the MCP surface to fix the same, and there provided at a periphery of the contact face is a separation surface retracted in a direction to be separated from the MCP surface. Thereby, provided is an MCP assembly having a construction enabled to prevent damage to the MCP in manufacturing and handling.

5 Claims, 16 Drawing Sheets

(a)

(b)

(c)

(a)

(b)

MICRO CHANNEL PLATE ASSEMBLY

BACKGROUND OF THE INVENTION

1. Field of the Invention

The present invention relates to a microchannel plate assembly which combines a microchannel plate and electrodes used for multiplying incident electrons in a charged particle detector and the like.

2. Related Background Art

Microchannel plates (hereinafter, referred to as "MCPs") have been known as devices for multiplying and outputting incident electrons. A typical MCP structure is shown in FIG. 11. An MCP 6 is a thin disk-like structure made mainly of glass, in which arranged are a large number of small-diameter holes 62 passing therethrough in the thickness direction except for an annular peripheral portion 61, and formed at both surfaces are conductive films 63 by evaporation. As the material of the conductive films 63, INCONEL (registered trademark) from Special Metals Corporation can be used, for example. The conductive film 63 is formed, without covering the entire surface of the MCP 6, with the peripheral portion 61 of the MCP 6 exposed 0.5 mm to 1.0 mm from the peripheral end.

The MCP 6, as shown in FIG. 12, as a result of arranging an input-side electrode 4 and an output-side electrode 7 at the sides of front and back surfaces, respectively, and being applied with a predetermined voltage by a power supply 15, discharges secondary electrons when charged particles 16 such as electrons or ions made incident into the holes 62 collide with sidewalls of the holes 62, thereby multiplying and outputting the incident electrons.

Because MCPs are made mainly of glass and used by being supplied with a high voltage in high vacuum as such, handling thereof requires caution. Because there may be a case of replacement not only in manufacturing but also after being incorporated in apparatuses due to the end of life and the like, techniques for integrating MCPs with input-side and output-side electrodes to facilitate handling in manufacturing and replacement have been developed.

The techniques described in JP2005-351887A (hereinafter, referred to as "Patent Document 1") and JP2007-87885A (hereinafter, referred to as "Patent Document 2") are examples of such techniques, in which the MCPs and electrodes are stored together in an outer shell and fixed for integration. FIG. 13 and FIG. 14 show the construction of a detector cartridge, which is an MCP assembly described in Patent Document 1. The detector cartridge 60 is a substantially disk-like structure as shown in FIG. 13, and an internal construction thereof is as shown in FIG. 14. Concretely, the two MCPs 55 and 56 are stored in a case 58 while being sandwiched with an input-side electrode 54 and an output-side electrode 57. In this case, the MCPs 55 and 56 are arranged in an opening located in the center of an annular centering ring 65 so as to prevent the MCPs 55 and 56 from in-plane misalignment. On a front surface of the input-side electrode 54, an insulator 53 made of an insulating material, a wire mesh-like mesh 52 and a mesh electrode 51, and a ring retainer 50 are arranged, and the ring retainer 50 and a case 58 are screw-mounted together.

SUMMARY OF THE INVENTION

In the above-mentioned detector cartridge 60, for reliably fixing the MCPs 55 and 56 while sandwiching with the input-side electrode 54 and the output-side electrode 57, it is necessary to provide the thickness of the centering ring 65 thinner than the thickness of the MCPs 55 and 56 overlaid with each other. Moreover, it is necessary to provide the inner diameter of the opening in the center of the centering ring 65 slightly larger than the outer diameter of the MCPs 55 and 56.

However, in the case of such a construction, as shown in FIG. 15, the centering ring 65 has not been fixed in a space enclosed by the input-side electrode 54 and the output-side electrode 57 and the case 58, and has been arranged in a state movable back and forth and up and down. Therefore, there is a possibility that the centering ring 65 contacts the MCPs 55 and 56 during transportation and the like to damage these.

Moreover, the fixation of the MCPs 55 and 56 is performed by screw-mounting the ring retainer 50 and the case 58 together by means of screws (not shown), because the screw-mounting sites are located outside in terms of the radial direction of the MCPs 55 and 56, when an excessive pressing force is applied to the screw-mounting positions, end portions of the MCPs 55 and 56 contact the MCP-side surfaces of the input-side electrode 54 and the output-side electrode 57, as shown in FIG. 16, and this may lead to damage to the MCPs 55 and 56.

Even if the MCPs 55 and 56 are not damaged, when the positional relationship between each electrode 54, 57 and the MCP 55, 56 has changed as shown in FIG. 16, the conductive film formed on the surface of the MCP 55, 56 and each electrode 54, 57 may be separated to thereby cause a conduction failure.

In view of the above-described problems, it is an object of the present invention to provide an MCP assembly having a construction enabled to prevent damage to the MCPs in manufacturing and handling and occurrence of a conduction failure.

In order to achieve the above-mentioned object, an MCP assembly according to the present invention is, in an MCP assembly comprised of one or a plurality of laminated MCPs, and an annular input-side electrode and output-side electrode which sandwich both surfaces of the MCP(s) and integrally fix, wherein each of the input-side electrode and output-side electrode has a substantially annular contact face that contacts the MCP surface to fix the same at an inner edge side, and have a separation surface retracted in a direction to be separated from the MCP surface at a periphery of the contact face of at least one of the input-side electrode and output-side electrode.

As a result of the periphery of the contact face being separated, contact of a corner of the MCP with the electrode surface can be prevented even when the electrode is inclined at the time of fixation of the MCP, so that damage to the MCP can be suppressed. Moreover, deformation of the electrode can be suppressed to suppress the occurrence of a conduction failure.

At least one of these input-side electrode and output-side electrode may include, at a periphery of the separation surface outside of an outer edge of the relevant MCP, a projection face projecting from an extended plane of the contact face.

Because providing such a construction facilitates positioning of the MCP, a centering ring can be eliminated, so that MCP damage by a centering ring during transportation can be effectively prevented, which is preferable.

It is more preferable that both the input-side and output-side electrode have the separation surface, because the above-mentioned effects can be improved.

It suffices that the MCP assembly further includes a fixing member for fixing the MCP by further sandwiching from both sides the input-side electrode and the output-side electrode having sandwiched the MCP therebetween and being screw-mounted further outside of a periphery of the MCP. Alternatively, the MCP assembly may further include a case for storing and fixing the MCP sandwiched between the input-side electrode and the output-side electrode. These constructions allow reliably fixing the MCP.

DESCRIPTION OF THE PREFERRED EMBODIMENTS

Figure 1:
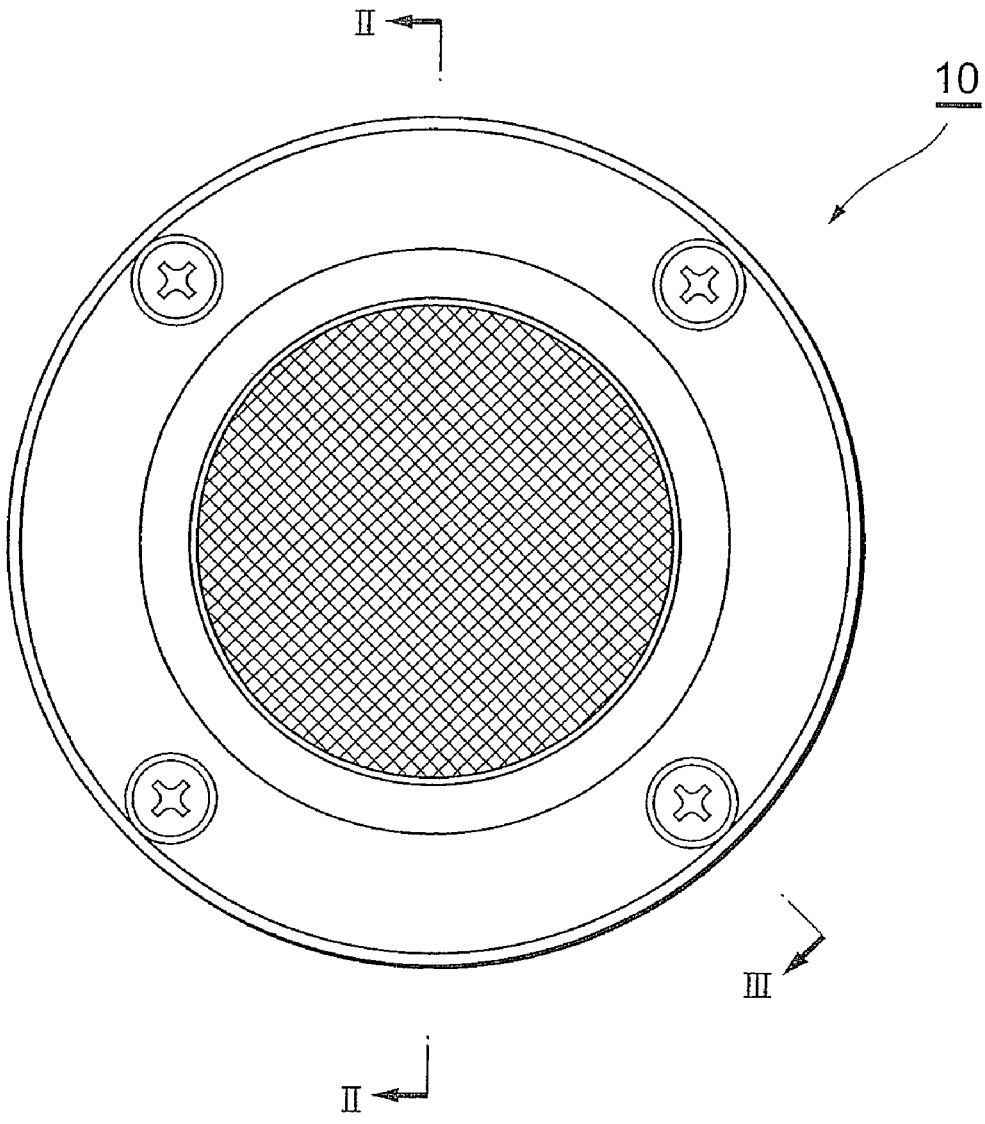
FIG. 1 is a front view of an MCP assembly of a first embodiment of the present invention.

Hereinafter, preferred embodiments of the present invention will be described in detail with reference to the accompanying drawings. To facilitate the comprehension of the explanation, the same reference numerals denote the same parts, where possible, throughout the drawings, and a repeated explanation will be omitted. Also, dimensional ratios of construction elements in the respective drawings have been overdrawn in part for the sake of description, and do not always coincide with actual ratios.

First Embodiment

Figure 2:
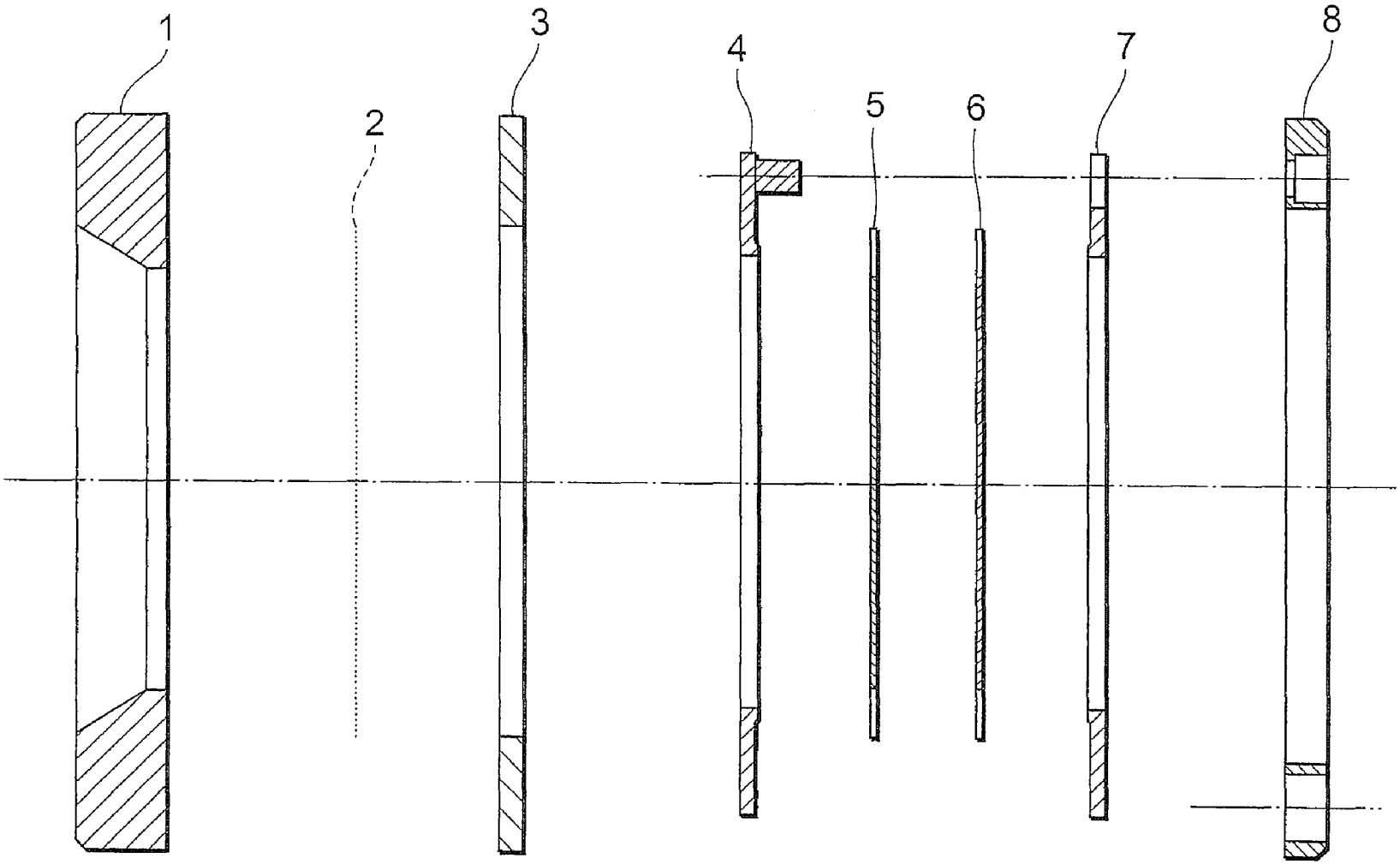
FIG. 2 is a cross-sectional exploded view taken along a line II-II thereof.
Figure 3:
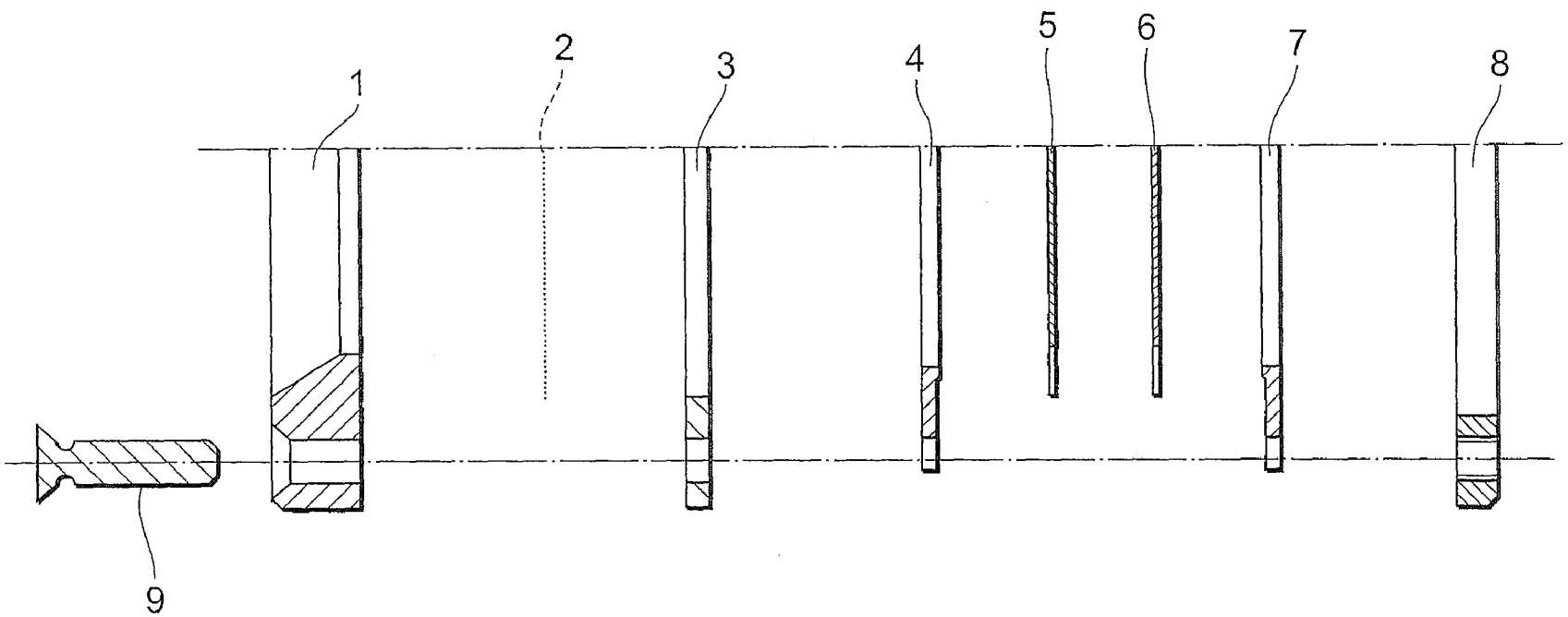
FIG. 3 is a cross-sectional exploded view taken along a line from the center to III thereof.

FIG. 1 to FIG. 3 show a construction of an MCP assembly 10, which is a first embodiment of the present invention. FIG. 1 is a front view of the MCP assembly 10, FIG. 2 is a cross-sectional exploded view taken along a line II-II thereof, and FIG. 3 is a cross-sectional exploded view taken along a line from the center to III of FIG. 1.

The MCP assembly 10 is a substantially disk-like structure, which assumes a construction for which a mesh electrode 1 having an opening in the center, a wire mesh-like mesh 2, an insulator 3 being an annular insulating material, an annular input-side electrode 4, two MCPs 5 and 6, an annular output-side electrode 7, and a holder 8 having an opening in the center are stacked up from the front side of FIG. 1, and a screw 9 is inserted from the side of the mesh electrode 1 to screw-mount the mesh electrode 1 on the holder 8, thereby fixing the MCPs 5 and 6 while sandwiching with the input-side electrode 4 and the output-side electrode 7. A combination of the holder 8, the mesh electrode 1, the mesh 2, and the insulator 3 corresponds to a fixing member according to the present invention.

A manufacturing method for the MCP assembly 10 will be described with reference to FIG. 4 and FIG. 5. The MCP assembly 10 in the following description differs in the peripheral structure of the input-side electrode 4 and the output-side electrode 7 from the assembly shown in FIG. 1 to FIG. 3. Each electrode 4 and 7 of the assembly shown in FIG. 1 to FIG. 3 is provided with a U-shaped notch at a part where the screw 9 is arranged, while each electrode 4 and 7 of the assembly in the following description is provided with a through-hole through which the screw 9 penetrates. Both assemblies are identical in other aspects of the construction.

Figure 4:
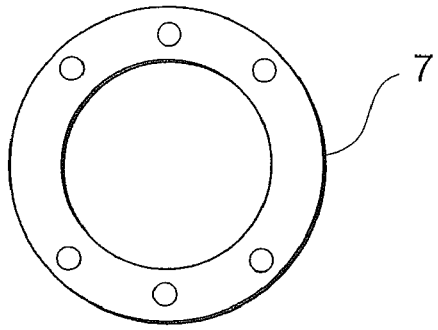
FIG. 4(*a*) to FIG. 4(*c*), FIG. 5(*a*), and FIG. 5(*b*) are views showing a manufacturing method for an assembly resembling the MCP assembly of FIG. 1.
Figure 4:
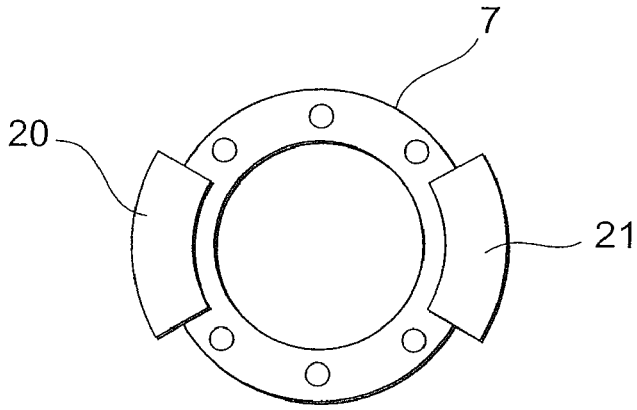
Figure 4:
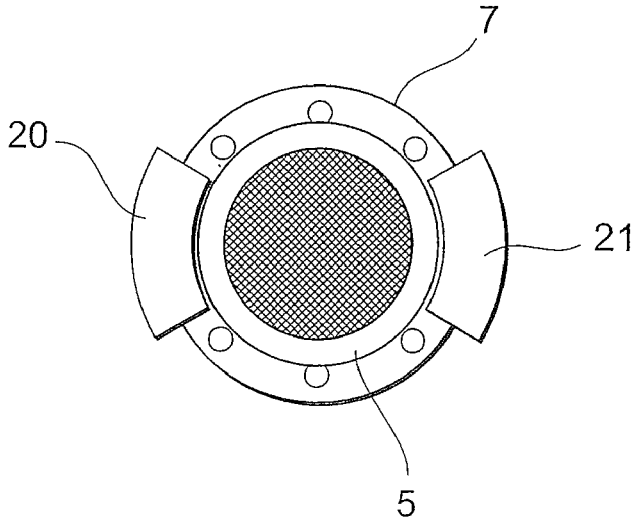

First, as shown in FIG. 4(*a*), the output-side electrode 7 is prepared, and this is set on the holder 8 (in this figure, the holder 8 is hidden by the output-side electrode 7). Next, jigs 20 and 21 each having a shape for which a part of a ring is cut off are set at opposing positions on the periphery of the output-side electrode 7, respectively (see FIG. 4(*b*)). Then, the MCP 6 and the MCP 5 are placed on the output-side electrode 7 (see FIG. 4(*c*)). At this time, it suffices to perform positional alignment of the MCP 6 and the MCP 5 using the jigs 20 and 21.

Figure 5:
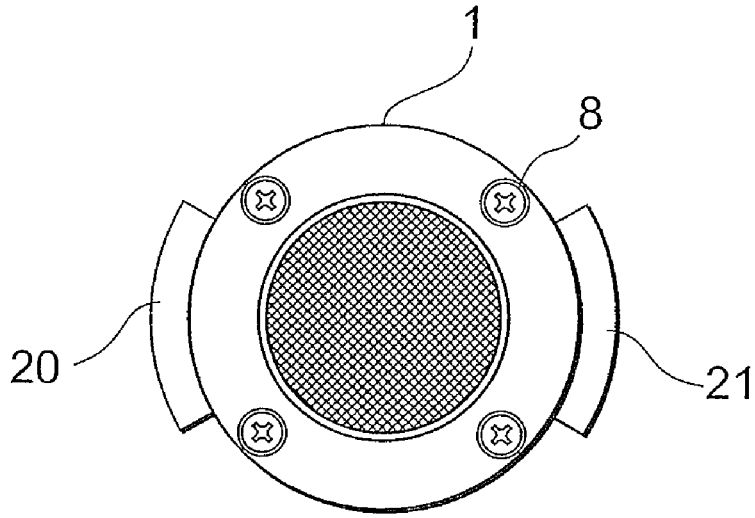
Figure 5:
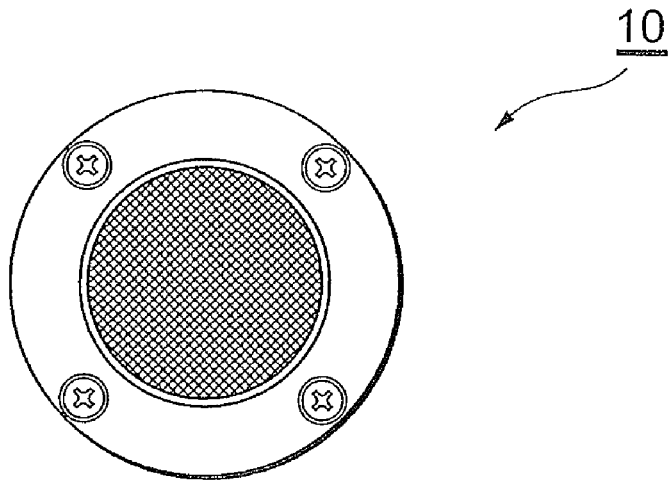

Next, the MCP 5 is overlaid with the input-side electrode 4, the insulator 3, the mesh 2, and the mesh electrode 1 in order (see FIG. 5(*a*)). At this time, the jigs 20 and 21 reach a state sandwiched with the input-side electrode 4 and the output-side electrode 7, so that the MCPs 5 and 6 can be accurately held between the input-side electrode 4 and the output-side electrode 7. Here, the screw 9 is inserted from the side of the mesh electrode 1 to screw-mount the mesh electrode 1 on the holder 8. By removing the jigs 20 and 21 after screw mounting, the MCP assembly 10 of the present embodiment is completed (see to FIG. 5(*b*)).

Figure 6:
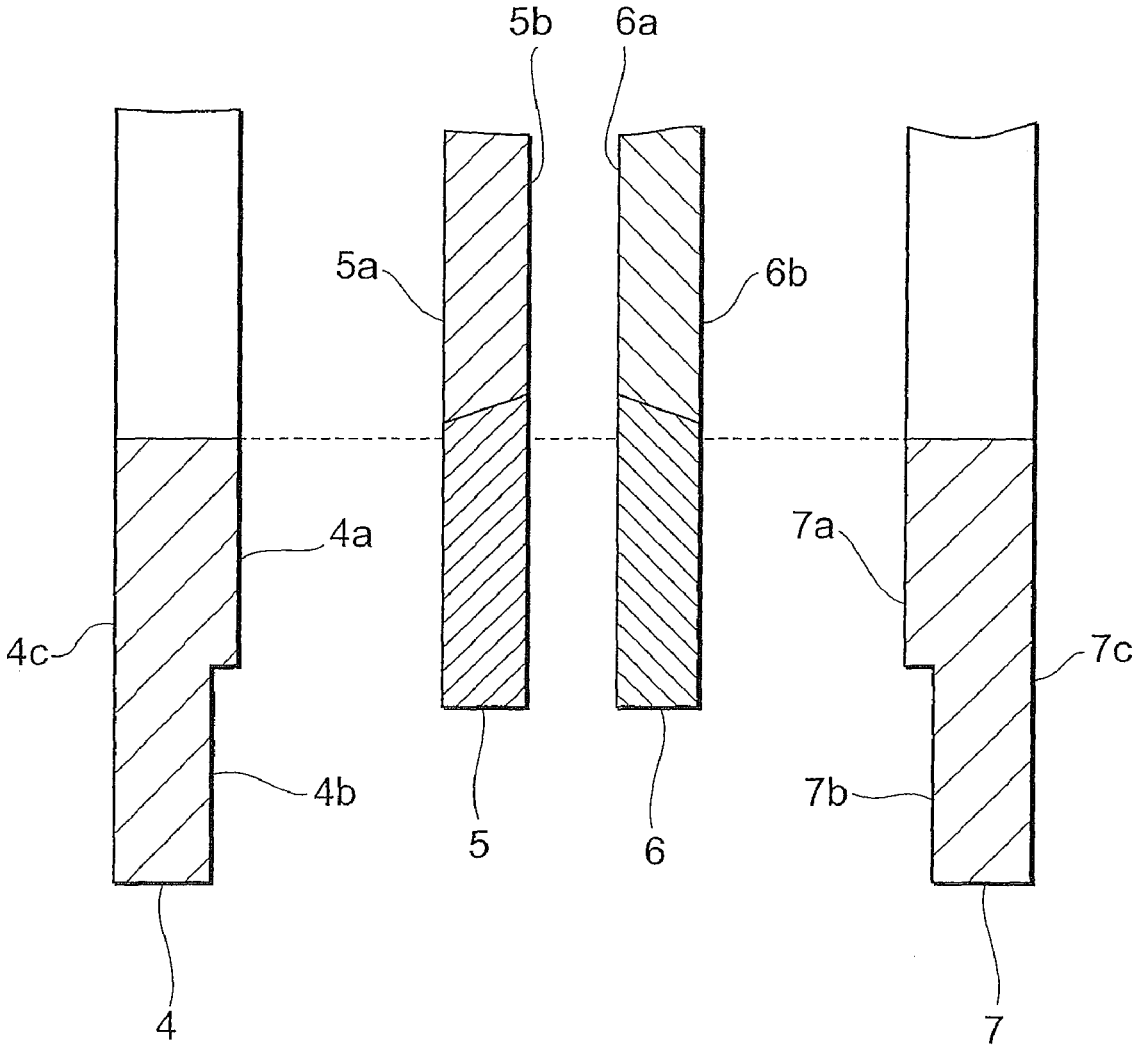
FIG. 6 and FIG. 7 are schematic views showing a structure of the peripheral edge portions of MCPs in the MCP assembly of FIG. 1.
Figure 7:
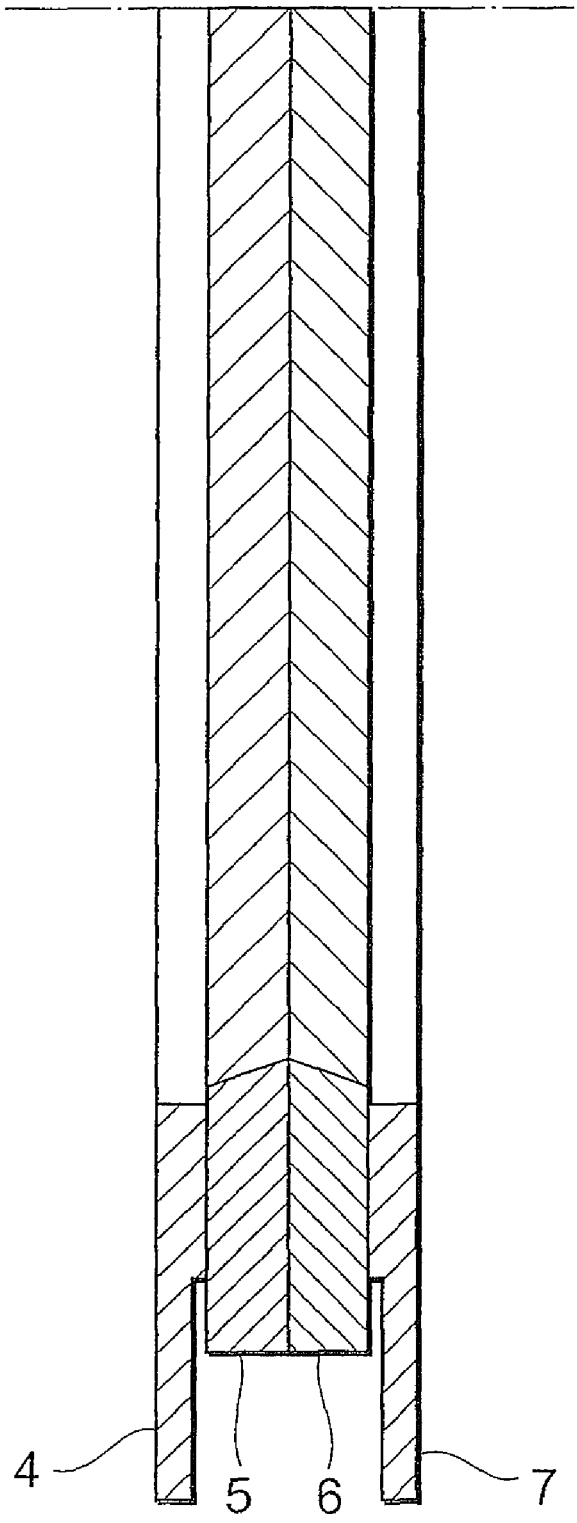
Figure 11:
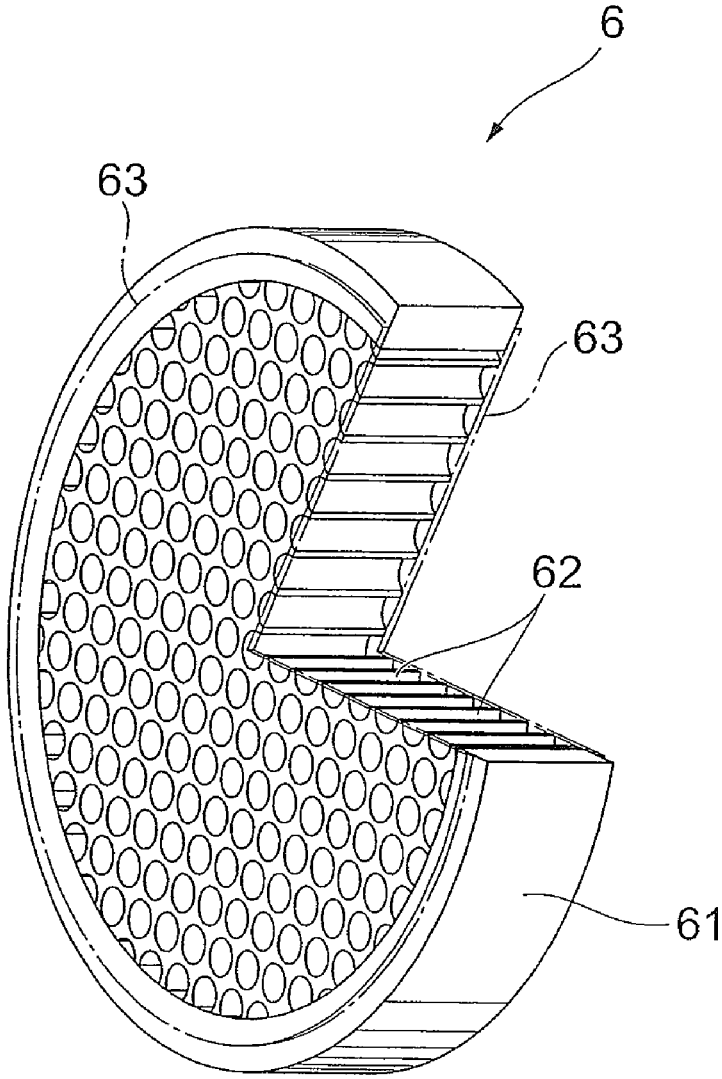
FIG. 11 is a perspective view showing a typical MCP structure.
Figure 12:
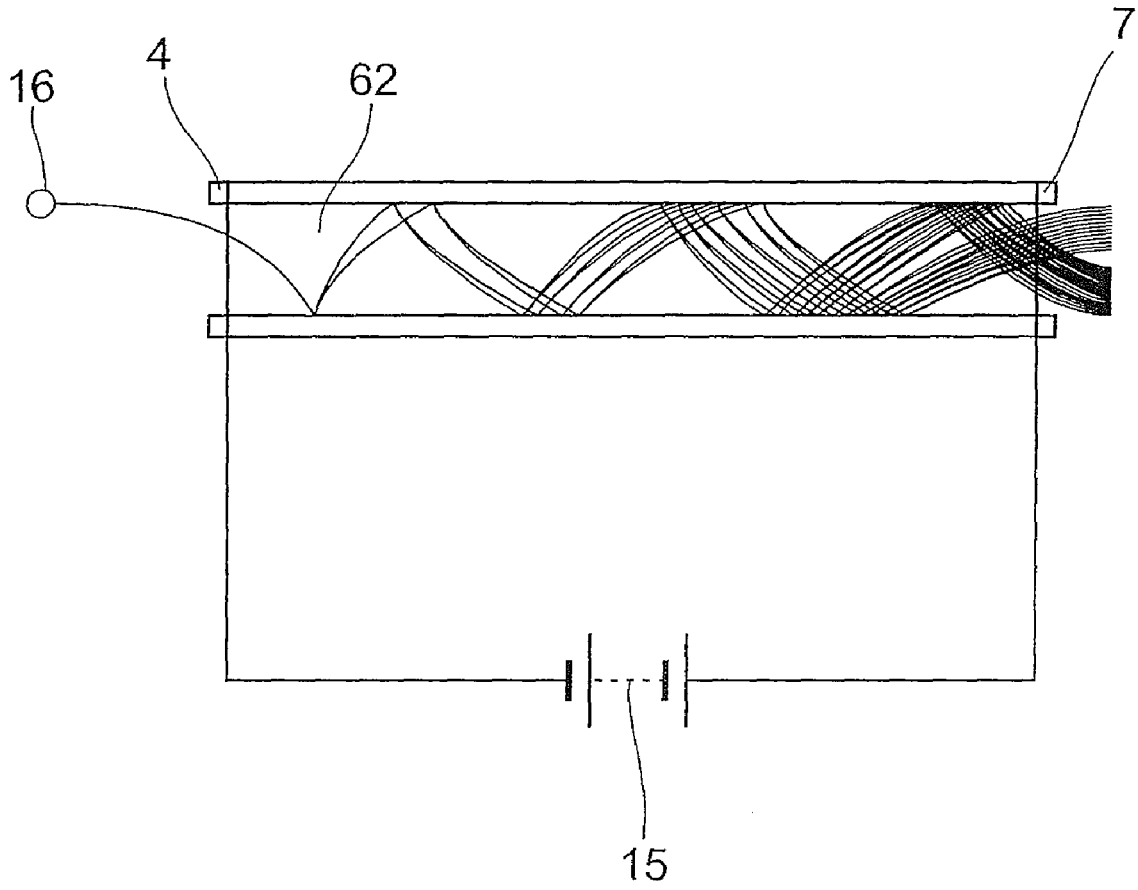
FIG. 12 is a view for explaining a usage example of an MCP.
Figure 13:
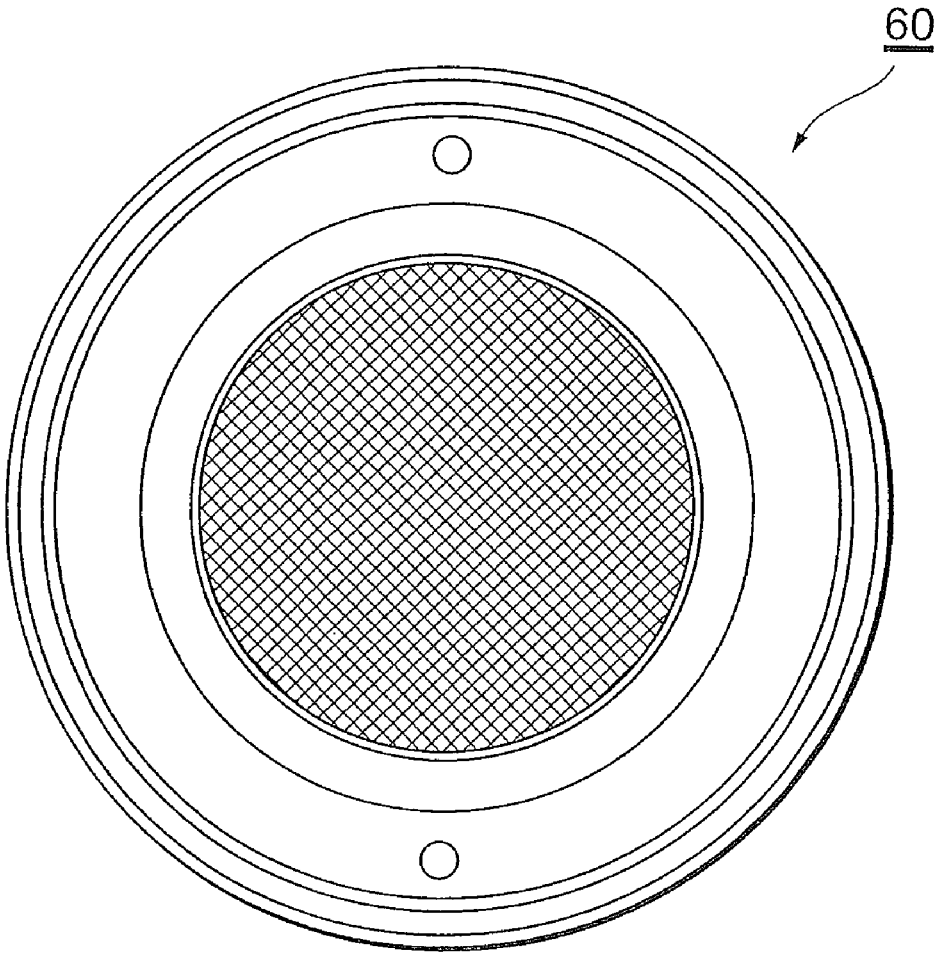
FIG. 13 is a front view showing a conventional MCP assembly.
Figure 14:
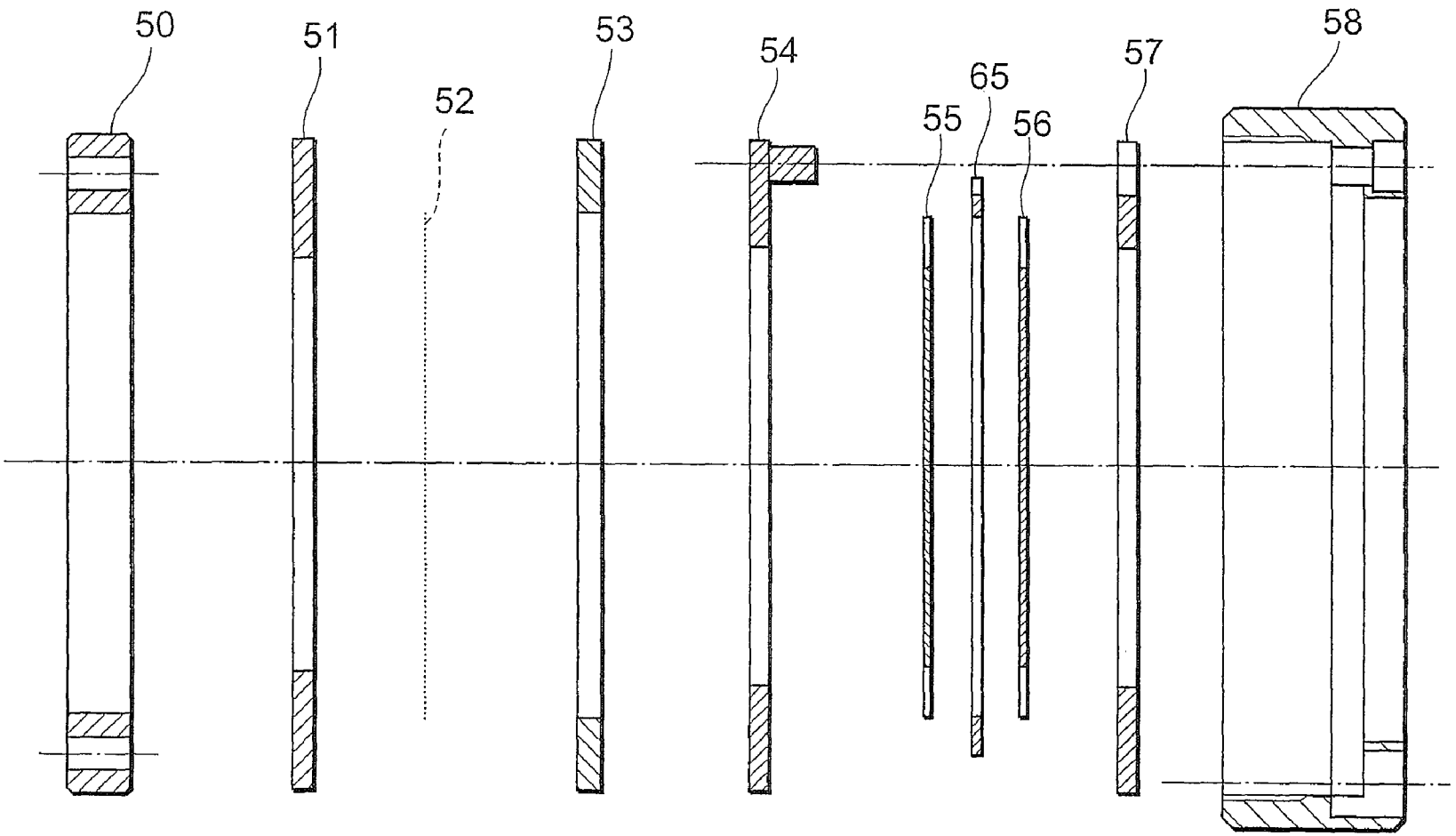
FIG. 14 is a sectional exploded view thereof.
Figure 15:
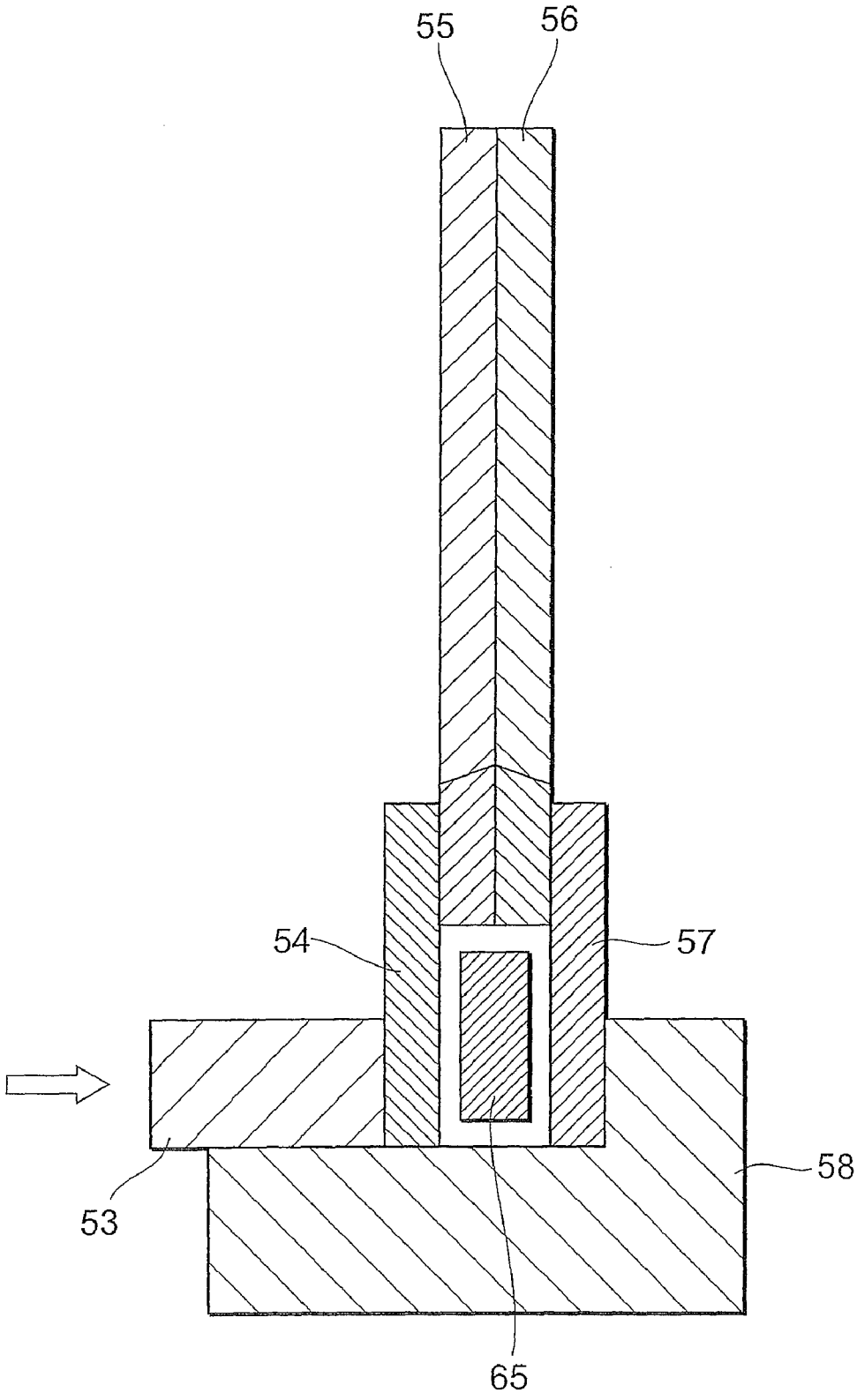
FIG. 15 is a sectional schematic view in the vicinity of MCP peripheries thereof.

FIGS. 6 and 7 are schematic views showing a structure of the peripheral edge portions of the MCPs 5 and 6, the input-side electrode 4, and the output-side electrode 7. Here, illustration of a conductive film (see FIG. 11) formed at both surfaces of each of the MCPs 5 and 6 is omitted.

The MCPs 5 and 6 each have a thickness of 300 μm, and are each provided with a conductive film having a thickness of some thousands of angstroms (some hundreds of nanometers) at both surfaces. These MCPs 5 and 6 are arranged with an output surface 5*b* of the MCP 5 and an input surface 6*a* of the MCP 6 overlaid with each other. Here, the central axis of each electron multiplying hole (a hole 62 shown in FIG. 11) of the MCP 5, 6 is slightly inclined with respect to an axis perpendicular to the central axis perpendicular to the input/output surface. Therefore, the inner edge of a peripheral portion in the MCP 5 and 6 is also formed not parallel to the central axis perpendicular to the input/output surface of each of the MCPs 5 and 6, but slightly inclined with respect thereto.

While being formed as an identical plane at the side of a surface 4*c* opposite to a face 4*a* to contact the MCP 5, the input-side electrode 4 is, around the contact face 4*a* to contact an input surface 5*a* of the MCP 5, made thinner than at the part of the contact face 4*a*, retracted to the surface 4*c* side from an extended plane of the contact face 4*a*, and formed as a separation surface 4*b* further separated than the contact face 4*a* with respect to the input surface 5*a*. Likewise, while being formed as an identical plane at the side of a surface 7*c* opposite to a face 7*a* to contact the MCP 6, the output-side electrode 7 is, around the contact face 7*a* to contact an input surface 6*a* of the MCP 6, made thinner than at the part of the contact face 7*a*, retracted to the surface 7*c* side from an extended plane of the contact face 7*a*, and formed as a separation surface 7*b* further separated than the contact face 7*a* with respect to the input surface 6*a*. The electrodes 4 and 7 each have a thickness of 1 mm at the central portion, and a thickness of 0.9 mm at the part where the separation surface 4*b* and 7*b* is formed.

Figure 16:
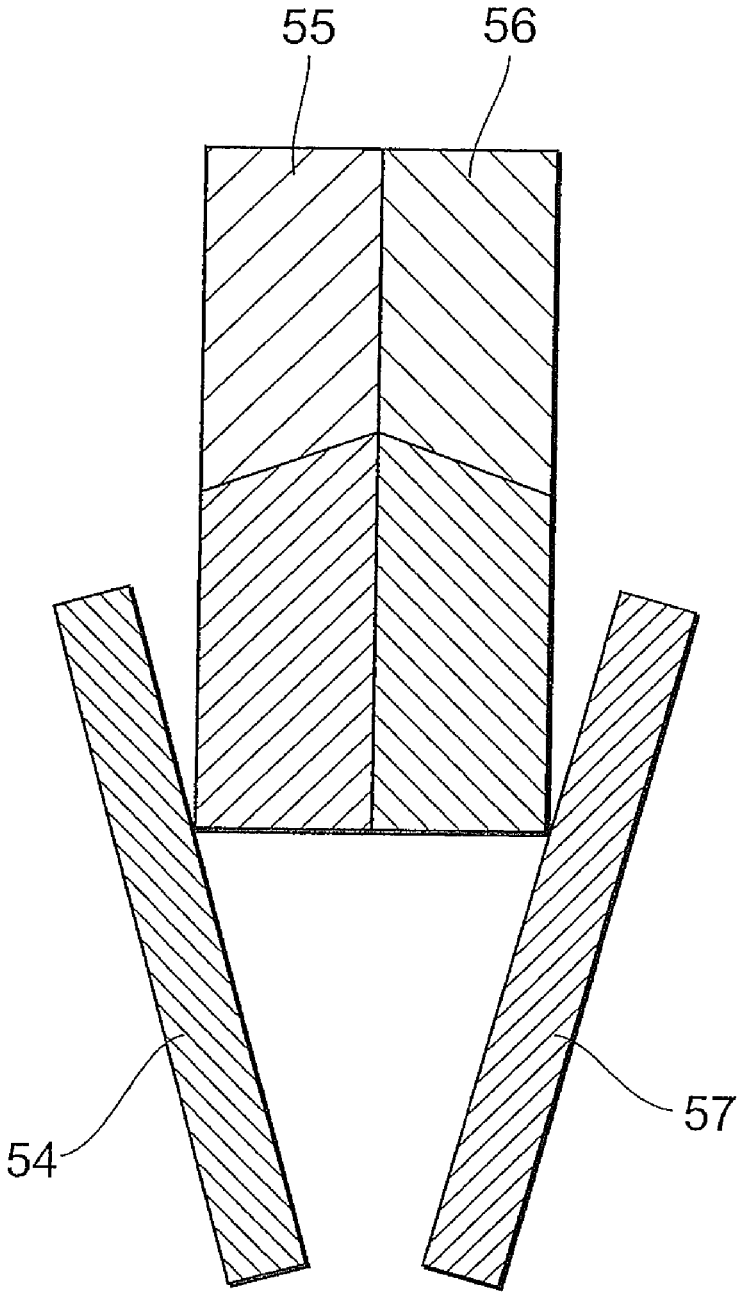
FIG. 16 is a view for explaining MCP damage that can occur on the MCP peripheries thereof.

By thus separating a corner part of the MCP 5 and 6 from the input-side electrode 4 or the output-side electrode 7 to contact the MCP 5 or 6, even when such a situation occurs, in the same manner as shown in FIG. 16, that the separation surface 4*b* and 7*b* approaches at one side of the MCP 5 and 6 while the input-side electrode 4 and the output-side electrode 7 remain sandwiching the MCPs 5 and 6 therebetween, occurrence of a state of contact of the separation surface 4*b* and 7*b* with the corner of the MCP 5 and 6 can be suppressed, so that damage to the MCP 5 and 6 can be suppressed.

Further, in the MCP assembly 10, because of being fixed by screw mounting further outside of the peripheries of the MCPs 5 and 6 due to the construction described above, the input-side electrode 4 and the output-side electrode 7 are also to fix the MCPs 5 and 6 sandwiched in the center by a force applied to the peripheral edge portions thereof, however, because providing the separation surface 4*b* and 7*b* allows more satisfactorily maintaining the contact ability of each contact face 4*a* and 7*a* with the conductive film formed on each of the input surface 5*a* of the MCP 5 and the output surface 6*b* of the MCP 6, an effect of suppressing the occurrence of a conduction failure that can be caused by deformation of these electrodes can also be obtained.

When the MCPs 5 and 6 are thinned, the input-side electrode 4 and the output-side electrode 7 to be arranged at both sides thereof are approximated by that extent, and a problem of an electrical insulation resistance failure may occur between both electrodes, however, adopting the above-mentioned construction makes, further outside of the peripheries of the MCPs 5 and 6, the input-side electrode 4 and the output-side electrode 7 be separated from each other, and thus occurrence of the electrical insulation resistance failure can be suppressed.

Moreover, adopting the above-described construction eliminates the necessity of providing a centering ring that has been conventionally used for positional alignment of the MCPs 5 and 6, and damage to the MCPs 5 and 6 that has been caused by a centering ring never occurs. Further, in the conventional structure, because a hollow structure has been produced on the peripheries of the MCPs, this has been a drawback when performing evacuation after installation in an apparatus, however, according to the construction of the present embodiment, no hollow structure is produced, which thus facilitates evacuation, and the time thereof can be reduced.

Figure 8:
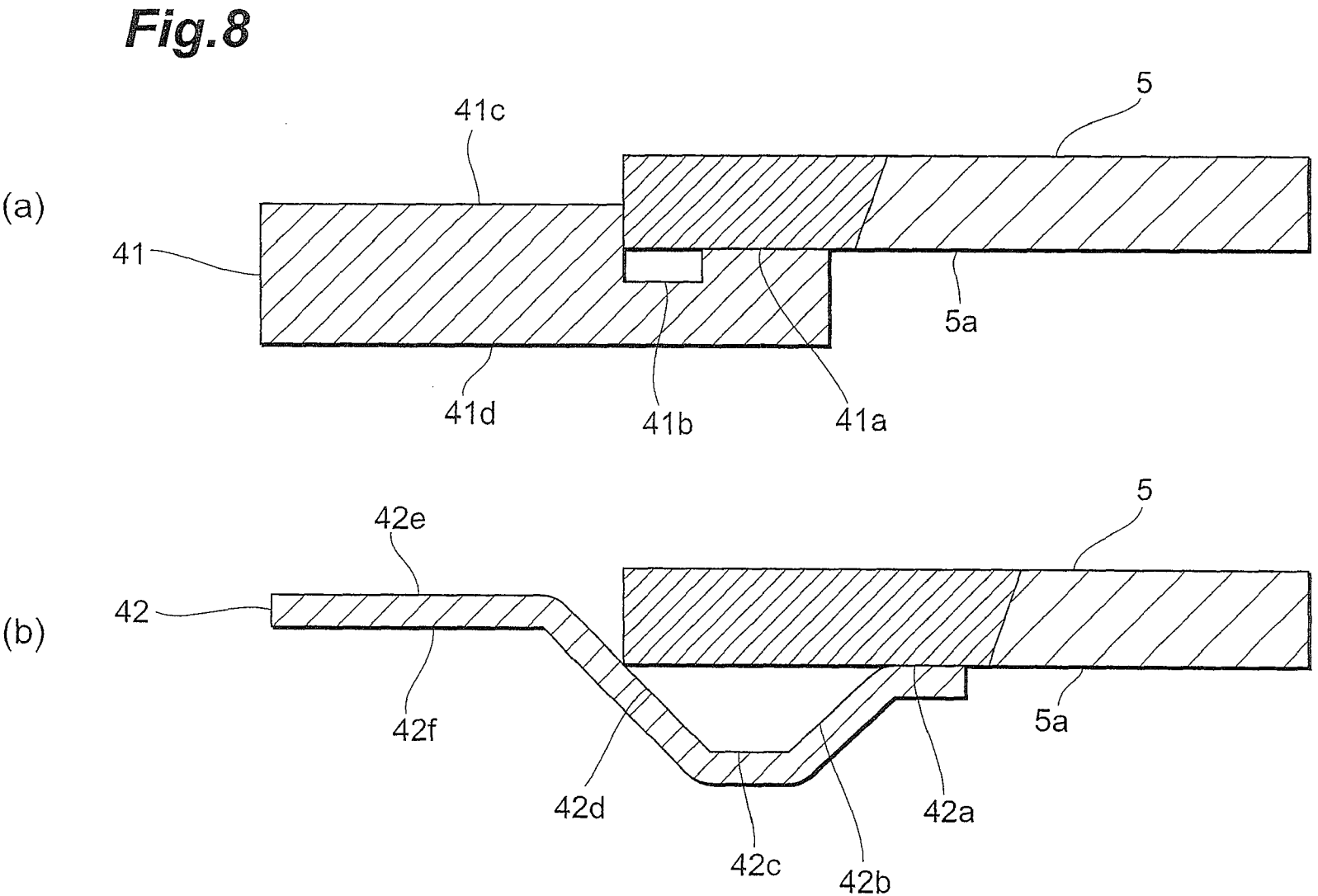
FIG. 8(*a*) and FIG. 8(*b*) are views showing modifications of an input-side electrode in the MCP assembly of FIG. 1.

The construction of each electrode 4 and 7 is not limited to a construction with a thinned peripheral edge portion. FIG. 8 show modifications of the construction of an electrode peripheral edge portion. In an input-side electrode 41 shown in FIG. 8(*a*), a separation surface 41*b* is formed at an outer edge of a contact face 41*a* to contact the input surface 5*a* of the MCP 5, and further formed at that outer edge is a projection face 41*c* projecting from an extended plane of the contact face 41*a*. A surface 41*d* at the side opposite to these faces is formed as an identical plane. The input-side electrode 41 allows not only securing satisfactory contact with the input surface 5*a* of the MCP 5 by the contact face 41*a* but also effectively suppressing damage to the corner of the MCP 5 by the separation surface 41*b*, in the same manner as in the above-mentioned electrode 4. Further, using the projection face 41*c* makes it also possible to perform positional alignment of the MCP 5 at high accuracy, and it also becomes possible to easily perform assembly.

An electrode 42 shown in FIG. 8(*b*), which is the same as the electrode 41 in the construction including a separation surface 42*c* and a projection face 42*e* located outside of a contact face 42*a*, differs therefrom in the point that a face 42*b* and 42*d* between the contact face 42*a* and the separation surface 42*c*; the separation surface 42*c* and the projection face 42*e* is inclined with respect to the contact face 42*a* or the like to form a continuous surface. An opposite surface 42*f* of these faces is formed as a continuous surface, not as an identical plane. In the construction of the electrode 42 as well, the same effect as that of the electrode 4 can be obtained.

Here, although a description has been given of an embodiment for which two MCPs are combined, three or more MCPs may be laminated. In that case, it suffices to arrange the MCPs so as to alternate in the direction of inclination of the electron multiplying holes.

Second Embodiment

Figure 9:
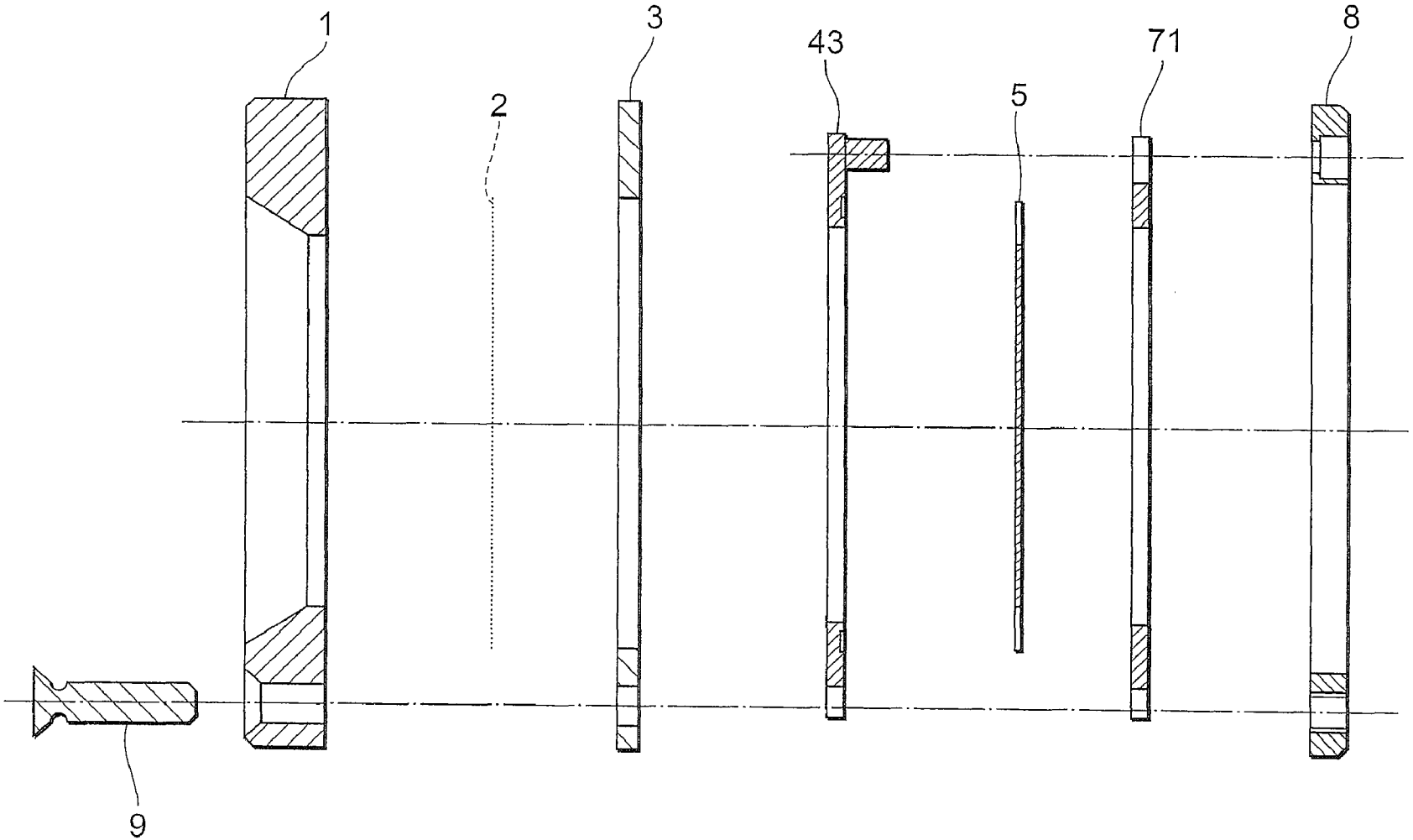
FIG. 9 is a cross-sectional exploded view of an MCP assembly of a second embodiment of the present invention.

FIG. 9 shows a cross-sectional exploded view of an MCP assembly, which is a second embodiment of the present invention. Unlike the first embodiment, the MCP assembly of this embodiment has only one MCP 5, and an input-side electrode 43 has the construction shown in FIG. 8(*a*), while an output-side electrode 71 is in a flat plate shape having no unevenness at both input and output surfaces. The output-side electrode 71 to be in a flat plate shape is formed so as to have a thickness larger than the maximum thickness of the input-side electrode 43.

In the case of a construction with only one MCP 5, deformation resulting from screw mounting and the like of the input-side electrode 43 and the output-side electrode 71 is smaller than that in the case with a plurality of MCPs. In the present embodiment, as a result of providing such a construction as in the above, deformation easily occurs at the side of the input-side electrode 43 having a recess portion formed as an annular groove called a separation surface as well as being thin in thickness as compared to the output-side electrode 71 in a flat plate shape, however, having the separation surface allows suppressing damage to the MCP 5 while securing contact of the input-side electrode 43 with a conductive film formed on the surface of the MCP 5, and thus occurrence of a conduction failure can also be suppressed.

Here, although an embodiment for which a separation surface is provided on the input-side electrode 43 has been mentioned, there may be a construction where the output-side electrode 71 has a separation surface, and there may be a construction where both electrodes have separation surfaces in the same manner as in the first embodiment. Moreover, the structure of an electrode having a separation surface may be in the embodiment shown in FIG. 6, FIG. 8(*a*), or FIG. 8(*b*).

Third Embodiment

Figure 10:
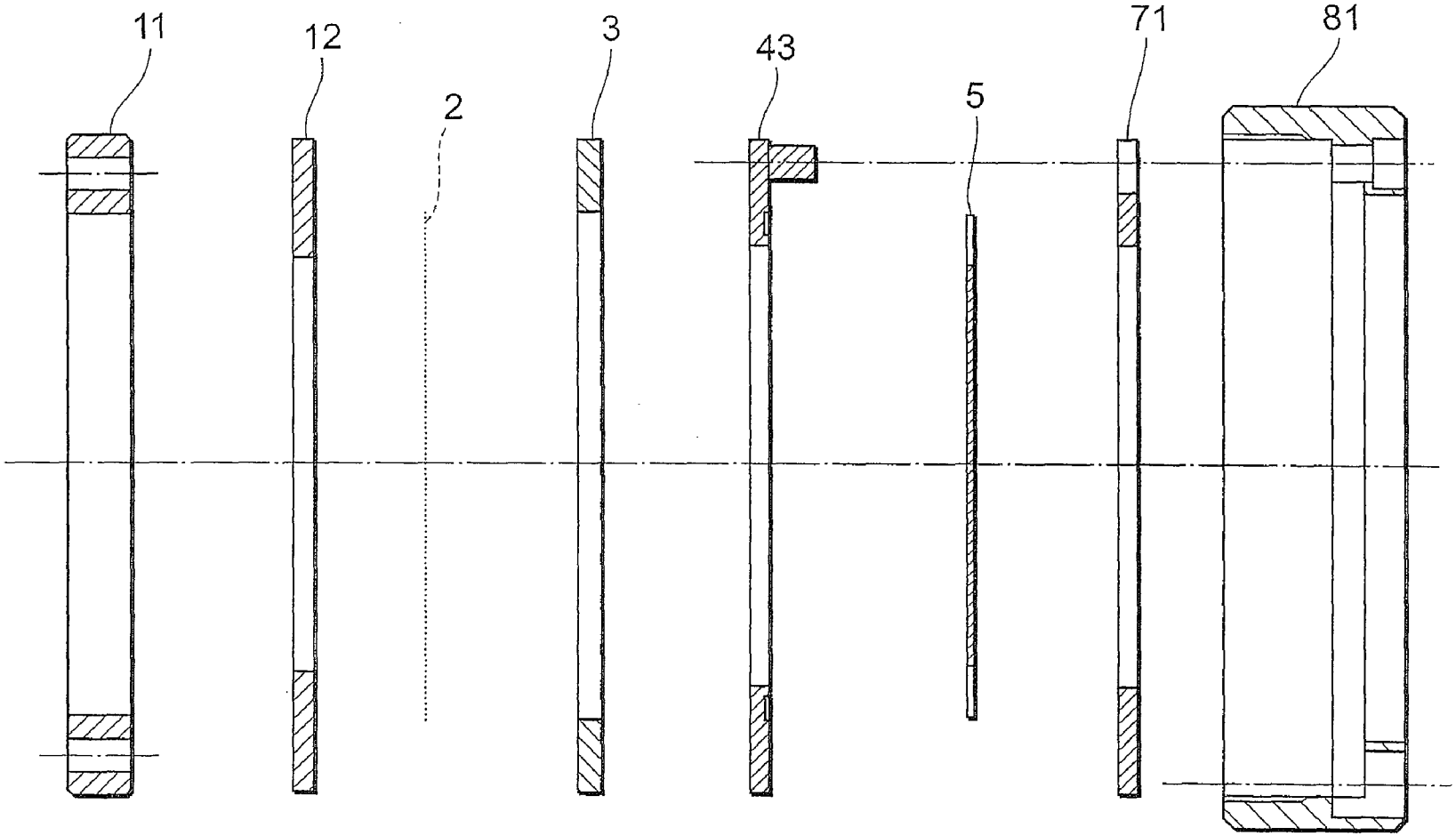
FIG. 10 is a cross-sectional exploded view of an MCP assembly of a third embodiment of the present invention.

FIG. 10 shows a cross-sectional exploded view of an MCP assembly, which is a third embodiment of the present invention. This embodiment is identical in construction to the second embodiment, and differs in the structure for fixing the same, which has a construction close to that of the conventional art.

Concretely, an output-side electrode 71, an MCP 5, an input-side electrode 43, an insulator 3, a mesh 2, and a flat plate-shaped mesh electrode 12 are overlaid with one another in a holder 81 having a round box structure, a ring retainer 11 is arranged thereon, and a screw (not shown) is inserted in the ring retainer 11 from its front surface to screw-mount the ring retainer 11 on the holder 81. The holder 8 and the ring retainer 11 corresponds to a case according to the present invention.

Providing such a construction still allows obtaining the same effect as that of the first embodiment and the second embodiment. According to the present embodiment, it becomes possible to easily adopt, in an apparatus using an MCP assembly with a conventional construction, an MCP assembly according to the present invention in place of the MCP assembly with a conventional construction.

In this embodiment as well, there may be a construction where the output-side electrode 71 has a separation surface, and there may be a construction where both electrodes have separation surfaces as in the first embodiment. Moreover, the structure of an electrode having a separation surface may be in the mode shown in FIG. 6, FIG. 8(*a*), or FIG. 8(*b*).

In all of the above embodiments, a description has been given of a mode having a mesh electrode 1 and 12, however, the mesh electrode is not an element essential for an MCP assembly, and a construction not using the same can even be adopted. When, for example, when the mesh electrode 1 is not used in the first embodiment, it suffices to adopt a construction where the insulator 3 and the holder 8 are screw-mounted as a fixing member.

What is claimed is:

1. A microchannel plate assembly comprised of one or a plurality of laminated microchannel plates, and a annular input-side electrode and output-side electrode which sandwich both surfaces of said microchannel plate(s) and integrally fix, wherein each of the input-side electrode and output-side electrode has a substantially annular contact face that contacts the microchannel plate surface to fix the same at an inner edge side, and have a separation surface retracted in a direction to be separated from the microchannel plate surface at a periphery of the contact face of at least one of the input-side electrode and output-side electrode.

2. The microchannel plate assembly according to claim 1, wherein at least one of the input-side electrode and output-side electrode has a projection face projecting from an extended plane of the contact face at a periphery of the separation surface outside of an outer edge of the relevant microchannel plate.

3. The microchannel plate assembly according to claim 1, wherein both of the input-side electrode and output-side electrode have the separation surface.

4. The microchannel plate assembly according to claim 1, further comprising a fixing member for fixing the microchannel plate by further sandwiching from both sides of microchannel plate sandwiched between the input-side electrode and the output-side electrode and being screw-mounted further outside of a periphery of the microchannel plate.

5. The microchannel plate assembly according to claim 1, further comprising a case for storing and fixing the microchannel plate sandwiched between the input-side electrode and the output-side electrode.

* * * * *